US009450307B2

(12) United States Patent
Petted et al.

(10) Patent No.: US 9,450,307 B2
(45) Date of Patent: Sep. 20, 2016

(54) FLEXIBLE PLANAR INVERTED F ANTENNA

(71) Applicant: L.S. Research, LLC, Cedarburg, WI (US)

(72) Inventors: Brian E. Petted, Cedarburg, WI (US); Mark R. Wolski, Mequon, WI (US)

( * ) Notice: Subject to any disclaimer, the term of this patent is extended or adjusted under 35 U.S.C. 154(b) by 204 days.

(21) Appl. No.: 14/298,200

(22) Filed: Jun. 6, 2014

(65) Prior Publication Data

US 2015/0357717 A1 Dec. 10, 2015

(51) Int. Cl.
*H01Q 1/38* (2006.01)
*H01Q 9/04* (2006.01)

(52) U.S. Cl.
CPC ..... *H01Q 9/0407* (2013.01); *H01Q 1/38* (2013.01); *Y10T 29/49018* (2015.01)

(58) Field of Classification Search
CPC ..... H01Q 1/38; H01Q 9/0407
USPC ..... 343/700 MS, 702, 846, 848
See application file for complete search history.

(56) References Cited

U.S. PATENT DOCUMENTS 6,480,156 B2 * 11/2002 Tsai ..... H01Q 9/16 343/700 MS
7,339,528 B2 * 3/2008 Wang ..... H01Q 1/243 343/700 MS
7,605,765 B2 * 10/2009 Ku ..... H01Q 1/243 343/700 MS
7,911,387 B2 * 3/2011 Hill ..... H01Q 1/243 343/700 MS
8,259,017 B2 * 9/2012 Schlub ..... H01Q 1/243 343/700 MS
9,257,750 B2 * 2/2016 Vazquez ..... H01Q 9/42

* cited by examiner

*Primary Examiner* — Tho G Phan
(74) *Attorney, Agent, or Firm* — Harness, Dickey & Pierce, P.L.C.

(57) ABSTRACT

A flexible inverted "F" antenna (PIFA) is shown. The flexible PIFA is not only applicable to flat surfaces, but it can be applied to curved surfaces, both convex and concave, without degrading performance. The flexible PIFA can also be used close to living bodies or to a metal surface without detuning. The flexible PIFA is formed from a flexible printed circuit board (PCB) having a metal layer on one side and over which a cover layer is positioned. The flexible PCB is folded, on its reverse side, around a flexible dielectric element with the covered metal layer facing outward to form a metal conducting service, an impedance matching stub and a ground plate. An adhesive layer forms a portion of the ground plate that is not in contact with the dielectric element. This adhesive layer is applied against the desired surface. A coaxial cable is electrically coupled to corresponding feed and ground tabs at the short circuit plate portion of the flexible PIFA.

23 Claims, 8 Drawing Sheets

Fig. 2
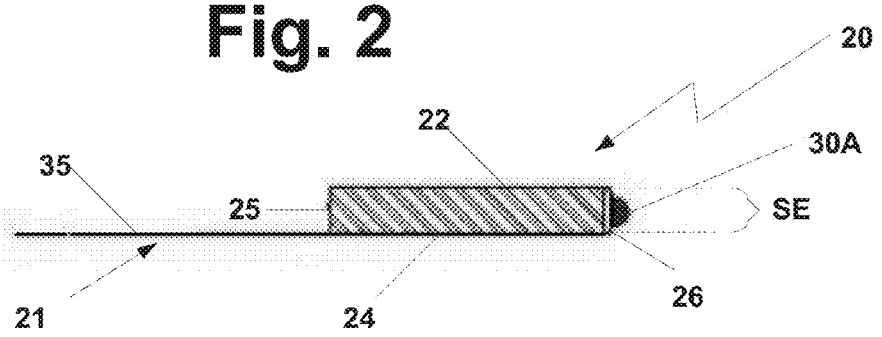
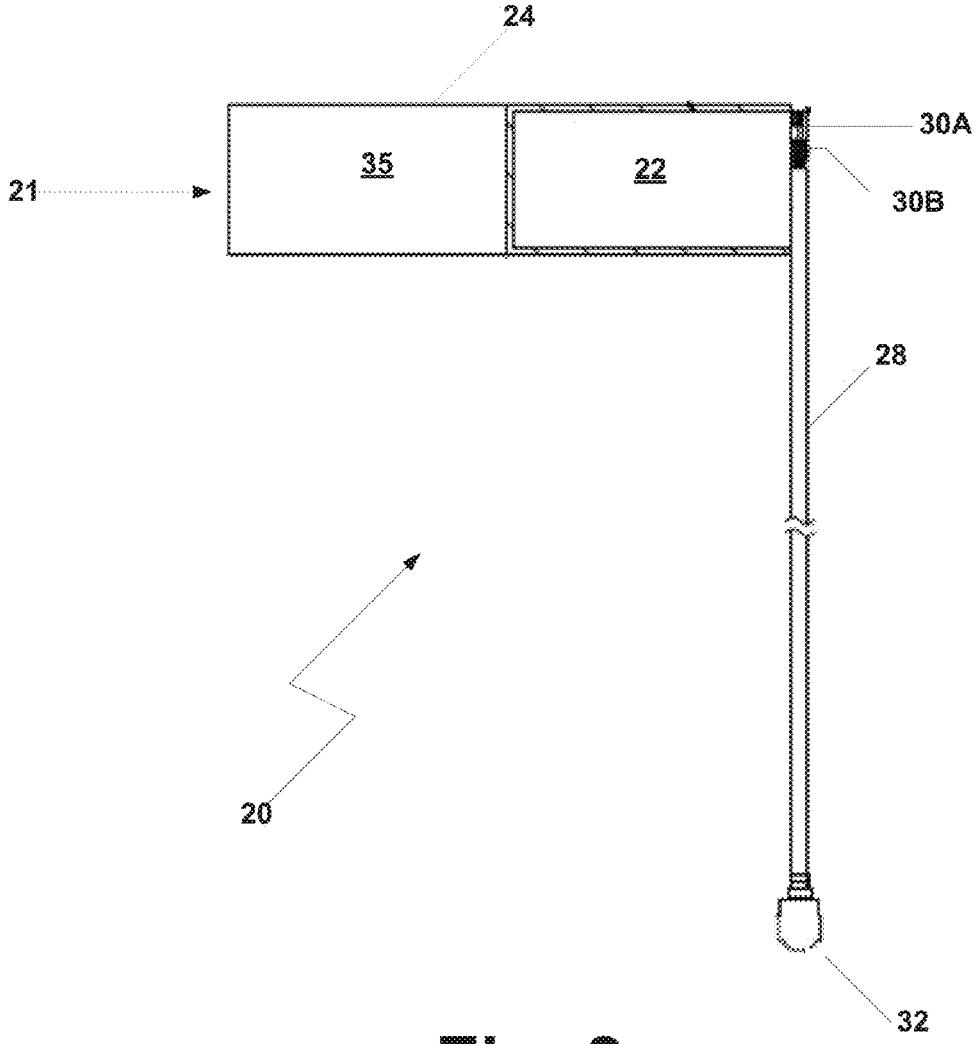
Fig. 3

Fig.8
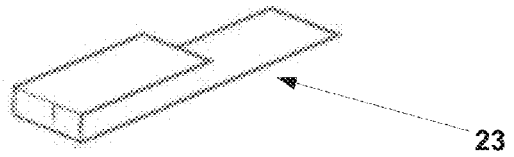
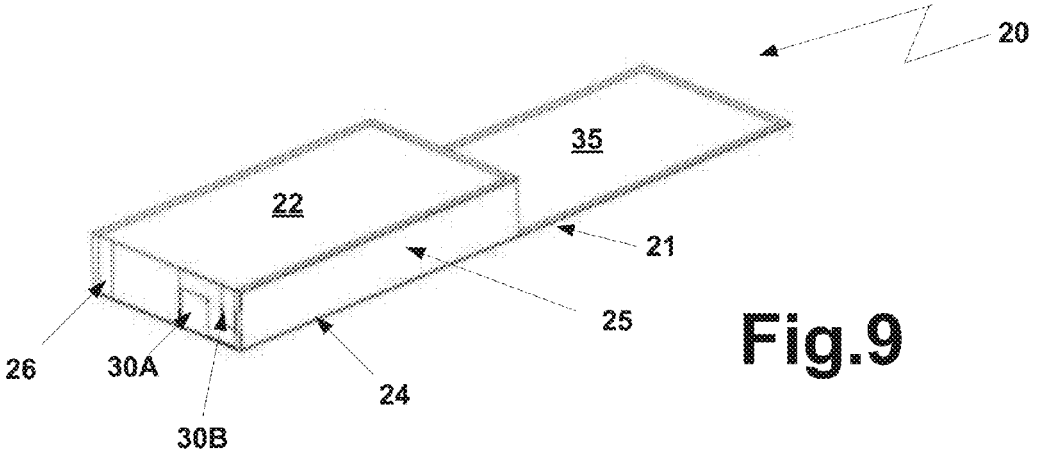
Fig.9

FLEXIBLE PLANAR INVERTED F ANTENNA

BACKGROUND OF THE INVENTION

The present invention relates generally to planar antennas and, more particularly, to planar inverted "F" antennas that can be flexed without degrading antenna performance.

The need for planar antennas has grown tremendously due to the proliferation of all kinds of hand-held and portable wireless devices where the area reserved for antenna location continues to shrink. This need has been met by planar antennas, especially those known as planar inverted "F" antennas, or PIFAs. As shown in FIG. 1, a PIFA 10 basically comprises a main conductive element 12 that is positioned in a parallel position above a ground plate 14 via a short circuit plate or pin 16 that is located on aligned sides of the main element 12 and the ground plate 14. An antenna feed point 18 is formed on the main element 12. A PIFA is basically a monopole antenna that has been folded down to be parallel with the ground plate. An air gap resides between the main element 12 and the ground plate 14. PIFAs often perform better than other types of antenna. PIFAs are typically attached to flat surfaces 17 as shown in FIG. 1.

However, there remains a need to provide for a flexible PIFA that can be used on various kinds of articles (e.g., curved enclosures, wearables, etc.) that do not include flat surfaces for mounting without degrading the PIFA antenna performance. In addition, this need also includes providing a PIFA that is less sensitive to the presence of a living body in the near field, as well as being less sensitive to the presence of metal, than are traditional antennas.

All references cited herein are incorporated herein by reference in their entireties.

BRIEF SUMMARY OF THE INVENTION

A flexible planar inverted "F" antenna (PIFA) is disclosed. The flexible PIFA comprises: a flexible printed circuit board (PCB, e.g., a flexible dielectric material, a polyimide PCB, etc.) having a metal layer (e.g., copper, etc.) on a first side that is covered by a cover layer (e.g., also a flexible dielectric material), wherein the flexible PCB comprises a second side opposite the first side; a flexible dielectric element (e.g., a flexible dielectric material, a foam, ethyl vinyl acetate foam, etc.) around which the second side is folded to form a main element and a ground plate that are substantially parallel to each other; a cable (e.g., a coaxial cable) having a first end electrically connected to the metal layer and having a second end adapted to electrically connect to a wireless device; and wherein the flexible PIFA comprises an antenna performance when electrically connected to the wireless device and wherein the antenna performance is maintained when the flexible PIFA is bent into a concave shape or into a convex shape.

A method for providing a flexible planar inverted "F" antenna (PIFA) that can operate when secured to a curved surface is disclosed. The method comprises: forming a metal layer (e.g., copper, etc.) on a first side of a flexible printed circuit board (PCB, e.g., a flexible dielectric material, a polyimide PCB, etc.) having a cover layer (e.g., also a flexible dielectric material) positioned over the metal layer, and wherein the flexible PCB has a second side opposite the first side; folding the second side around a flexible dielectric element (e.g., a flexible dielectric material, a foam, ethyl vinyl acetate foam, etc.) to form a main element and a ground plate that are substantially parallel to each other; electrically connecting a first end of a conductor (e.g., a cable) to the metal layer and electrically connecting a second end of the conductor to a wireless device to form an antenna comprising an antenna performance; and securing the ground plate to a concave surface or a convex surface and wherein the antenna performance is maintained while the flexible PIFA is in use.

A method for providing a flexible planar inverted "F" antenna (PIFA) that can operate when secured to a metal surface is disclosed. The method comprises: forming a metal layer (e.g., copper, etc.) on a first side of a flexible printed circuit board (PCB, e.g., a flexible dielectric material, a polyimide PCB, etc.) having a cover layer (e.g., also a flexible dielectric material) positioned over the metal layer and wherein the flexible PCB has a second side opposite the first side; folding the second side around a flexible dielectric element (e.g., a flexible dielectric material, a foam, ethyl vinyl acetate foam, etc.) to form a main element and a ground plate that are substantially parallel to each other; electrically connecting a first end of a conductor (e.g., a cable) to the metal layer and electrically connecting a second end of the conductor to a wireless device to form an antenna comprising an antenna performance; and securing the ground plate to the metal surface and wherein the antenna performance is maintained while the flexible PIFA is in use.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 2 is a side view of the flexible PIFA of the present invention;

FIG. 3 is a plan view of the flexible PIFA of the present invention showing the associated cable for connecting the flexible PIFA to a wireless device;

FIG. 8 is an isometric view showing only the folded cover layer of the present invention with the indicia omitted;

FIG. 9 is an isometric diagram of the flexible PIFA ready for use, with the indicia omitted;

DETAILED DESCRIPTION OF THE PREFERRED EMBODIMENTS

Figure 1:
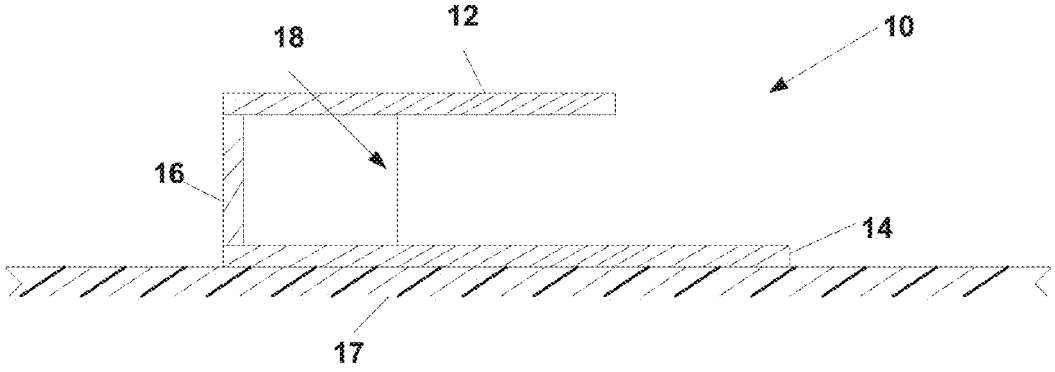
Fig. 1 (PRIOR ART)
FIG. 1 is an enlarged functional view of a conventional planar inverted "F" antenna (PIFA)

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

The flexible PIFA 20 of the present invention is designed to resist de-tuning when physically flexed, is less sensitive to the presence of a living body in the near field and is less sensitive to the presence of metal than are traditional antennas. One version of the flexible PIFA 20 is designed for operation in the 2.400-2.483 GHz frequency band while another version is designed for dual use in the 2.400-2.483 GHz frequency band as well as in the 5.15-5.85 GHz frequency band.

As shown most clearly in FIGS. 2-3, the flexible PIFA 20 comprises a flexible printed circuit board (PCB) 21 (e.g., a flexible dielectric material, a polyimide PCB, etc.) having a metal layer (e.g., copper layer, etc.) on one side which is covered by a cover layer 23 (e.g., also a flexible dielectric material, a flexible PCB, thin layer of paint, etc.). This laminate is then folded to form the main element 22, an impedance matching stub 26 and the ground plate 24. A dielectric material 25 (e.g., a foam, ethyl vinyl acetate foam, etc.) is positioned between the main element 22 and the ground plate 24. The flexible PIFA antenna feed to a wireless device is provided by a cable 28. The cable 28 (e.g., a coaxial cable, U.FL cable) is connected (e.g., soldered) to an antenna feedpoint comprising a feed tab 30A for connection to the cable's center conductor and a ground tab 30B for connection to the cable's outer conductor. It should be noted that this antenna feedpoint is located along the short edge SE of the flexible PIFA 20. This edge SE experiences the least amount of distortion when the flexible PIFA 20 is bent or flexed. Thus, such positioning minimizes any distortion in the antenna feedpoint when the main body of the flexible PIFA 20 is flexed or bent when applied to a curved surface. The other end of the cable 28 comprises a connector 32 (e.g., U.FL connector) for electrical connection with the wireless device.

Figure 4:
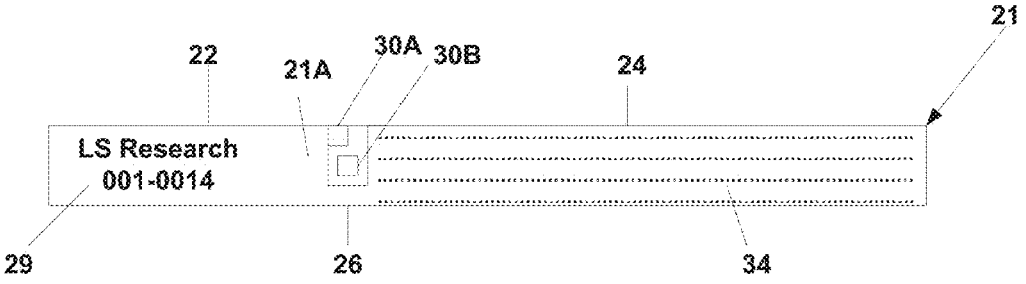
FIG. 4 is a plan view of the flexible printed circuit board (PCB) of the present invention before it is folded.
Figure 5:
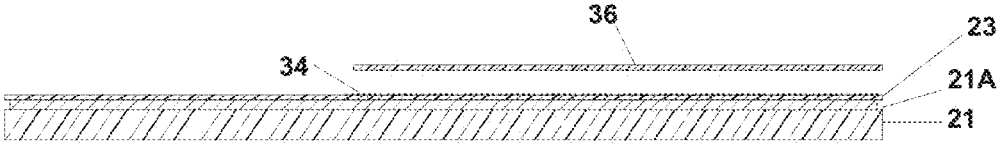
FIG. 5 is a side view of the flexible PCB before it is folded showing a release sheet that is removed from an adhesive layer on the cover layer.
Figure 6:
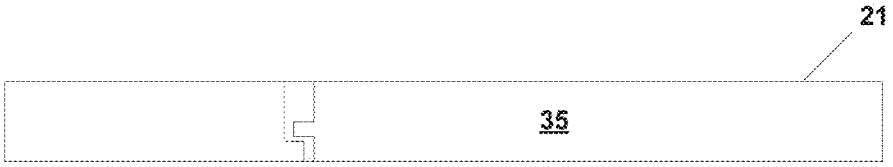
FIG. 6 is a plan view of the reverse side of the flexible PCB.

As shown most clearly in FIGS. 4-6 (the cable 28 and its connections have been omitted for clarity), the flexible polyimide PCB 21 having a metal layer 21A on one side is initially a flat element. A portion just off of center is etched or otherwise prepared to form the impedance matching stub 26 and the antenna feed/ground tabs 30A and 30B. The cover layer 23 (e.g., a flexible dielectric material, e.g., polyimide) is applied over the metal layer 21A. An adhesive 34 (e.g., 3M F9460PC) is applied to the cover layer 23 over the ground plate 24 portion of the flexible PIFA 20 as will be discussed below. A release sheet 36 is then applied over the adhesive 34 which is removable when the flexible PIFA 20 is to be applied to a surface. Product/assignee information 29 is provided on the cover layer 23 (e.g., silkscreened onto the cover layer 29) over the main conductive element. FIG. 6 shows the reverse side 35 of the flexible PIFA 20.

Figure 7:
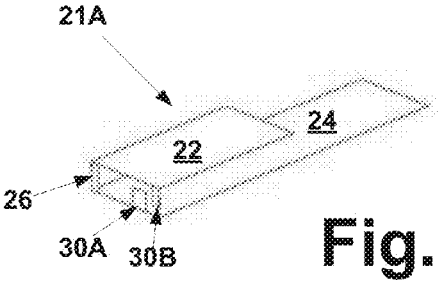
FIG. 7 is an isometric view showing only the folded metal layer of the present invention.

To form the flexible PIFA 20 into its operative condition, the dielectric element 25 is applied to the reverse side 35 and the polyimide PCB 21 is folded around the dielectric element 25 into the structure shown in FIG. 7. An adhesive may be applied to upper and lower surfaces of the dielectric element 25 to secure the foam to the reverse side 35 of the flexible PCB 21; in addition, another adhesive may also be applied to the reverse side 35 where the dielectric element 25 is in contact therewith. Again, the cable 28 and its connections are omitted for clarity. FIG. 7 shows how the metal layer 21A is positioned once the flexible PCB 21 is folded. FIG. 8 shows the cover layer 23 structure only when the flexible PIFA 20 is folded with the indicia 29 omitted. FIG. 9 shows the flexible PIFA 20 ready for use (the indicia 29 again being omitted).

Figure 10:
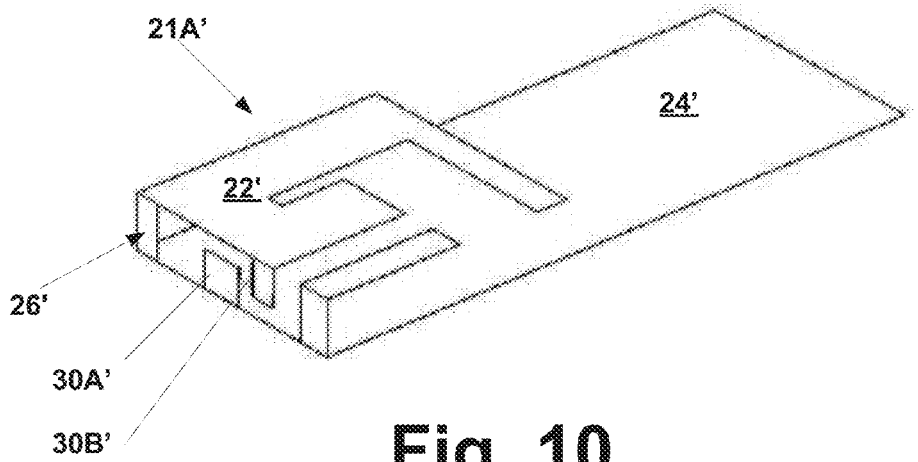
FIG. 10 is an isometric view showing only the folded metal layer of the dual band version of the present invention.
Figure 11:
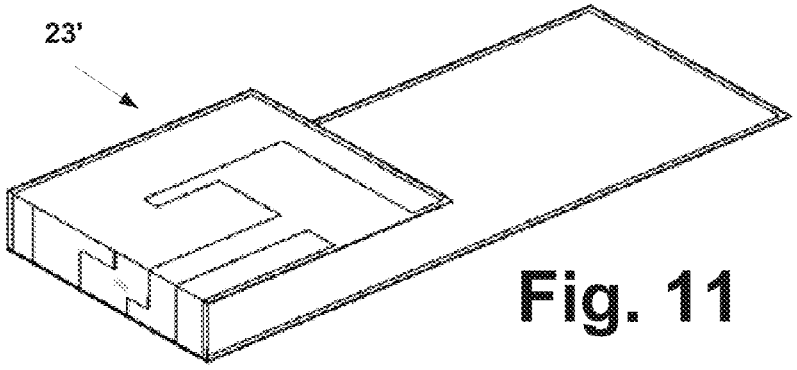
FIG. 11 is an isometric view showing only the folded cover layer of the dual band version of the present invention with the indicia omitted.
Figure 12:
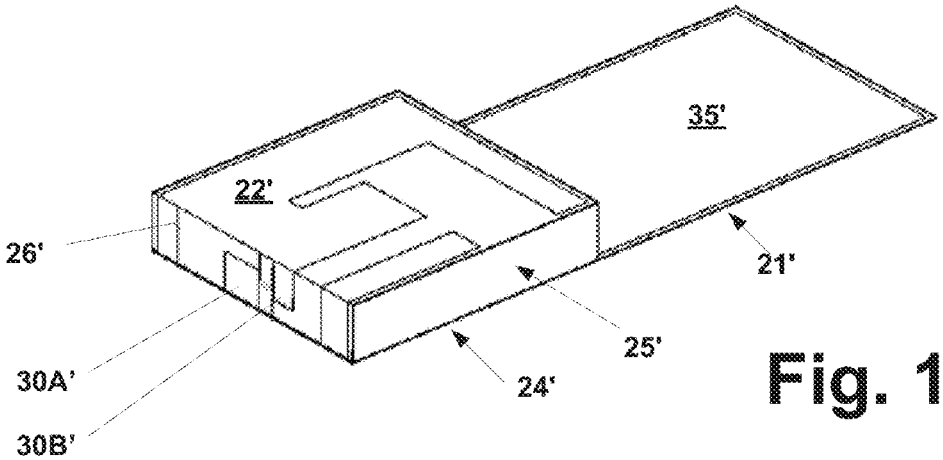
FIG. 12 is an isometric diagram of the dual band flexible PIFA ready for use, with the indicia omitted.

The dual band flexible PIFA 20 is similar in formation as shown in FIGS. 10-12, although the metal layer 21A' has a different configuration for the dual band operation. Thus, the reference numbers 21', 21A', 22', 23', 25', 26', 29' and 30A'-30B' indicate the corresponding components described earlier for the single band version of the flexible PIFA 20. As a result, the following description of the uses of flexible PIFA 20 applies to both the single band version of the flexible PIFA 20 as well as the dual band version of the same.

Figure 13:
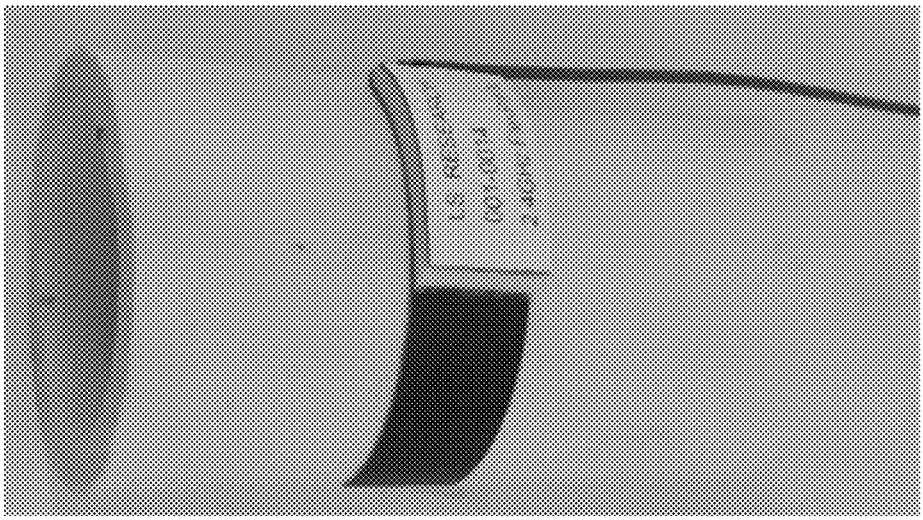
FIG. 13 shows the flexible PIFA of the present invention mounted to a convex surface.
Figure 14:
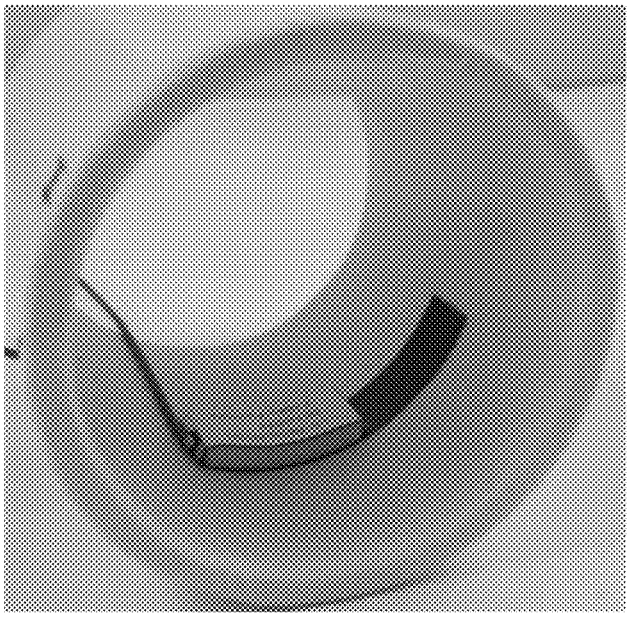
FIG. 14 shows the flexible PIFA of the present invention mounted to a concave surface.
Figure 15:
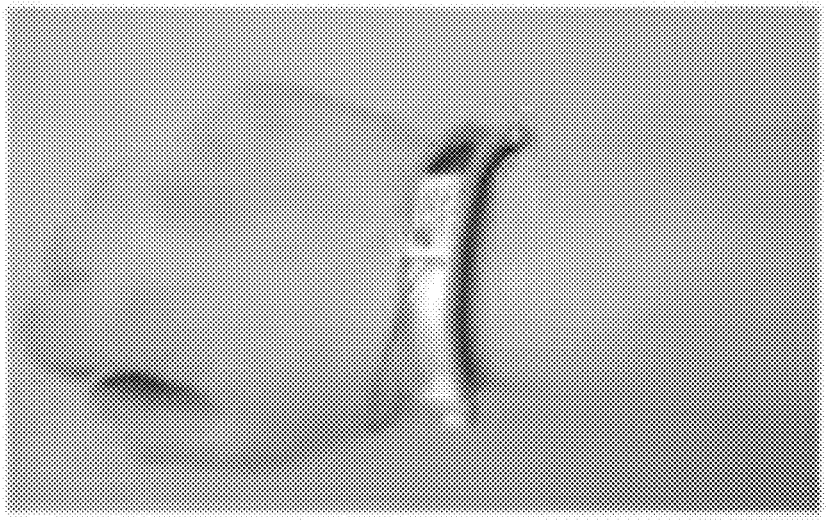
FIG. 15 shows the flexible PIFA of the present invention mounted within a bracelet that is worn around the wrist of a user.
Figure 16:
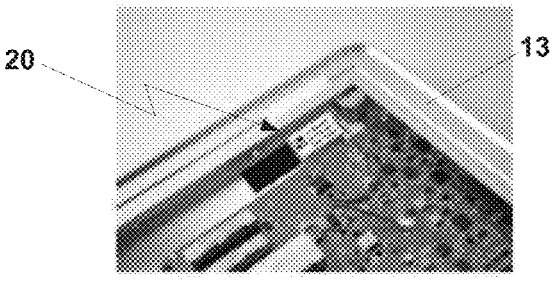
FIG. 16 shows the flexible PIFA of the present invention mounted within a metal enclosure.

The flexible PIFA 20 is now ready for application to any desired surface. To accomplish this, the release sheet 36 is removed from the PCB 21 and the flexible PIFA 20 is secured to the desired surface. For example, the flexible PIFA 20 can be mounted on curved surfaces as is shown in FIGS. 13-14. An example of another application of the flexible PIFA 20 is in use with a bracelet that is worn around the wrist of a user, as shown in FIG. 15. Moreover, because the flexible PIFA 20 is less sensitive to the presence of metal, it can be located in tight environments within metal enclosures, as shown in FIG. 16.

The following tables provide an overview, performance and physical characteristics, of the single band flexible PIFA 20 (2.400-2.483 GHz frequency band) as well as the dual band flexible PIFA 20 (2.400-2.483 GHz and 5.15-5.85 GHz frequency bands).

TABLE 1

Typical Operating Parameters/Characteristics of the Single Band Flexible PIFA 20

| Parameter/Characteristic | Value |
|---|---|
| 2.4 GHz Band Peak Gain | +3 dBi |
| Efficiency | >−1.5 dB |
| Impedance | 50 ohms |
| Polarization | Linear |
| VSWR | <2.0:1 |
| Frequency | 2400-2500 MHz |
| Weight | 1.13 g |
| Size | 41.4 mm × 10.8 mm × 3.4 mm (SE) |
| Operating Temperature | 40° C. to +85° C. |

TABLE 2

| Typical Operating Parameters/Characteristics of the Dual Band Flexible PIFA 20 | |
|---|---|
| Parameter/Characteristic | Value |
| 2.4 GHz Band Peak Gain | +2 dBi |
| 5 GHz Band Peak Gain | +3 dBi |
| Efficiency | >−1.4 dB |
| Impedance | 50 ohms |
| Polarization | Linear |
| VSWR | <3.0:1 |
| Frequency | 200-2500 GHz, 5150-5850 MHz |
| Weight | 1.13 g |
| Size | 39.6 mm × 15.0 mm × 3.5 mm (SE) |
| Operating Temperature | 40° C. to +85° C. |

Figure 17:
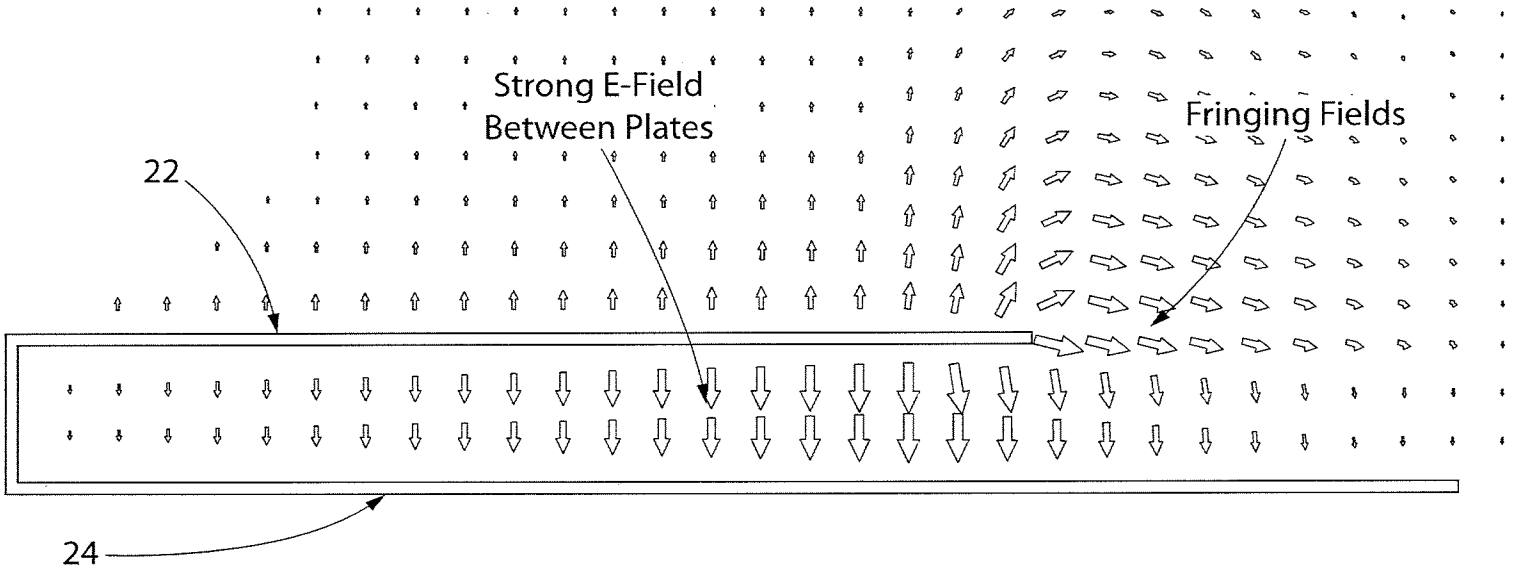
FIG. 17 shows an electric field radiation simulation for the flexible PIFA invention.

FIG. 17 shows the field that is operative when the flexible PIFA 20 is in use.

All such modifications and variations are intended to be included herein within the scope of this disclosure.

While the invention has been described in detail and with reference to specific examples thereof, it will be apparent to one skilled in the art that various changes and modifications can be made therein without departing from the spirit and scope thereof.

What is claimed is:

1. A flexible planar inverted "F" antenna (PIFA), said flexible PIFA comprising:

a flexible printed circuit board (PCB) having a metal layer on a first side that is covered by a cover layer, said flexible PCB comprising a second side opposite said first side;

a flexible dielectric element around which said second side is folded to form a main element and a ground plate that are substantially parallel to each other such that the main element and the ground plate are defined by the flexible PCB;

a cable having a first end electrically connected to said metal layer and having a second end adapted to electrically connect to a wireless device; and wherein said flexible PIFA comprises an antenna performance when electrically connected to said wireless device and wherein said antenna performance is maintained when said main element and ground plate are bent into a concave shape or into a convex shape.

2. The flexible PIFA of claim 1 wherein said first end of said cable is connected to an antenna feedpoint, said antenna feedpoint being located along an edge of said flexible PIFA that connects said main element to said ground plate for minimizing distortion of said antenna feedpoint whenever said flexible PIFA is bent into a concave shape or into a convex shape.

3. The flexible PIFA of claim 2 wherein said cable comprises a coaxial cable.

4. The flexible PIFA of claim 3 wherein said cover layer comprises a flexible dielectric material.

5. The flexible PIFA of claim 1 further comprising an adhesive layer applied upon a portion of said cover layer, said adhesive layer permitting said flexible PIFA to be secured to a desired surface.

6. The flexible PIFA of claim 1 wherein said flexible dielectric element comprises a foam material positioned between the main element and the ground plate.

7. The flexible PIFA of claim 1 wherein said flexible PCB comprises a flexible dielectric material.

8. The flexible PIFA of claim 1 wherein the flexible PIFA is designed for operation in a 2.400-2.483 GHz frequency band.

9. The flexible PIFA of claim 8 wherein the flexible PIFA is also designed for operation in a 5.15-5.85 GHz frequency band.

10. The flexible PIFA of claim 1, wherein the flexible PIFA is folded around the flexible dielectric element such that the cover layer faces outward, such that the flexible PIFA is designed to resist detuning when physically flexed, is less sensitive to a presence of a living body in the near field, and is less sensitive to a presence of metal, whereby the flexible PIFA is usable close to a living body or a metal surface without detuning.

11. The flexible PIFA of claim 1, wherein:

said first end of said cable is connected to an antenna feedpoint;

said antenna feedpoint being located along an edge of said flexible PIFA that connects said main element to said ground plate; and the flexible PIFA includes an impedance matching stub along the edge of said flexible PIFA that connects said main element to said ground plate.

12. A bracelet to be worn around a wrist of a user comprising the PIFA of claim 1.

13. A method for providing a flexible planar inverted "F" antenna (PIFA) that can operate when secured to a curved surface, said method comprises:

forming a metal layer on a first side of a flexible printed circuit board (PCB) having a cover layer positioned over said metal layer, and wherein said flexible PCB has a second side opposite said first side;

folding said second side around a flexible dielectric element to form a main element and a ground plate that are substantially parallel to each other such that the main element and the ground plate are defined by the flexible PCB;

electrically connecting a first end of a conductor to said metal layer and electrically connecting a second end of said conductor to a wireless device to form an antenna comprising an antenna performance; and securing said ground plate to a concave surface or a convex surface and wherein said antenna performance is maintained while said flexible PIFA is in use.

14. The method of claim 13 wherein said step of electrically connecting a first end of a conductor comprises connecting said first end of said conductor to an antenna feedpoint, said antenna feedpoint being located along an edge of said flexible PIFA that connects said main element to said ground plate for minimizing distortion of said antenna feedpoint whenever said flexible PIFA is bent into a concave shape or into a convex shape.

15. The method of claim 14 wherein said conductor comprises a coaxial cable.

16. The method of claim 13 wherein said step of securing said ground plate comprises applying an adhesive layer upon a portion of said cover layer over said ground plate, said adhesive layer permitting said flexible PIFA to be secured to said convex or said concave surface.

17. The method of claim 13 wherein the flexible PIFA is designed for operation in a 2.400-2.483 GHz frequency band.

18. The method of claim 17 wherein the flexible PIFA is also designed for operation in a 5.15-5.85 GHz frequency band.

19. A method for providing a flexible planar inverted "F" antenna (PIFA) that can operate when secured to a metal surface, said method comprises:

forming a metal layer on a first side of a flexible printed circuit board (PCB) having a cover layer positioned over said metal layer and wherein said flexible PCB has a second side opposite said first side;

folding said second side around a flexible dielectric element to form a main element and a ground plate that are substantially parallel to each other such that the main element and the ground plate are defined by the flexible PCB;

electrically connecting a first end of a conductor to said metal layer and electrically connecting a second end of said conductor to a wireless device to form an antenna comprising an antenna performance; and securing said ground plate to the metal surface and wherein said antenna performance is maintained while said flexible PIFA is in use.

20. The method of claim 19 wherein said step of electrically connecting a first end of a conductor comprises connecting said first end of said conductor to an antenna feedpoint, said antenna feedpoint being located along an edge of said flexible PIFA that connects said main element to said ground plate.

21. The method of claim 19 wherein said step of securing said ground plate comprises applying an adhesive layer upon a portion of said cover layer over said ground plate, said adhesive layer permitting said flexible PIFA to be secured to the metal surface.

22. The method of claim 19 wherein the flexible PIFA is designed for operation in a 2.400-2.483 GHz frequency band.

23. The method of claim 22 wherein the flexible PIFA is also designed for operation in a 5.15-5.85 GHz frequency band.

* * * * *